US006800819B2

(12) United States Patent
Sato et al.

(10) Patent No.: US 6,800,819 B2
(45) Date of Patent: Oct. 5, 2004

(54) TACTILE SWITCH UNIT

(75) Inventors: Mitsunori Sato, Akishima (JP); Tsuyoshi Takiguchi, Tachikawa (JP); Naoki Iwao, Hino (JP)

(73) Assignee: Japan Aviation Electronics Industry Limited, Tokyo (JP)

( * ) Notice: Subject to any disclaimer, the term of this patent is extended or adjusted under 35 U.S.C. 154(b) by 165 days.

(21) Appl. No.: 10/456,266

(22) Filed: Jun. 5, 2003

(65) Prior Publication Data

US 2003/0226745 A1 Dec. 11, 2003

(30) Foreign Application Priority Data

Jun. 7, 2002 (JP) ..... 2002-167535

(51) Int. Cl.[7] ..... H01H 9/00
(52) U.S. Cl. ..... 200/5 R; 200/314; 200/512
(58) Field of Search ..... 200/5 R, 512, 200/511, 520, 521, 313, 314, 341

(56) References Cited

U.S. PATENT DOCUMENTS 4,386,254 A * 5/1983 Eberhardt et al. ..... 200/339
5,280,146 A * 1/1994 Inagaki et al. ..... 200/341
5,561,279 A * 10/1996 Hattori et al. ..... 200/6 R
5,950,808 A * 9/1999 Tanabe et al. ..... 200/314
6,114,637 A * 9/2000 Nakao et al. ..... 200/5 R
6,180,895 B1 * 1/2001 Hutchinson et al. ..... 200/5 A

FOREIGN PATENT DOCUMENTS

JP 08315682 11/1996

* cited by examiner

*Primary Examiner*—Richard K. Lee
(74) *Attorney, Agent, or Firm*—David N. Lathrop, Esq.; Gallagher & Lathrop

(57) ABSTRACT

Outer ends of link members supported to a case and having their inner ends coupled to each other are coupled to a slider. A membrane sheet and a pusher are disposed one after the other on the slider, and a knob having molded therewith a surface sheet is fixed to the slider. On a bottom plate are mounted a tactile push-button switch and a light source. No matter which press area is depressed, the slider is uniformly translated by the link mechanism to actuate the push-button switch. The link mechanism, the slider, the membrane sheet except conductor portions, and the pusher are formed of a light transmitting material.

12 Claims, 20 Drawing Sheets

TACTILE SWITCH UNIT

BACKGROUND OF THE INVENTION

The present invention relates to a tactile switch unit and, more particularly, to a tactile switch unit which has a plurality of press areas corresponding to a plurality of switches and possesses an illuminating function.

FIGS. 1A, 1B and 1C schematically show the general configuration of a conventional switch unit of this kind disclosed in Japanese Patent Application Publication Gazette No. 8-315682. The illustrated prior art example has three press areas.

A keytop 1 is adapted to turn about a pivot shaft 1*a* extending along one end thereof. On the keytop 1 there is mounted a membrane sheet 2, on which is laminated a surface sheet 3.

The surface sheet 3 has a row of three press areas 3*a* each including a symbol 3*b* as depicted in FIG. 1A.

In the membrane sheet 2 there is formed right under each press area 3*a* a membrane switch 2*a* composed of a pair of opposed contacts. In FIG. 1B reference numerals 2*b*, 2*c* and 2*d* denote a top sheet, a bottom sheet and a spacer which constitute the membrane sheet 2.

Under the keytop 1 there is disposed a base plate 4, on which there are mounted light sources 5 and a "click" tactile push-button switch 6. In this example, three light sources 5 are provided each corresponding to one of symbols 3*b*, and the push-button switch 6 is located on the side opposite to the pivot shaft 1*a* of the keytop 1 and is held in abutment against the underside of the keytop 1.

In the unit switch of such a construction as mentioned above, when a desired one of the press areas 3*a* is pressed, the both contacts of the membrane switch 2*a* right under the pressed area 3*a* get into contact with each other as shown in FIG. 1C, by which the membrane switch 2*a* is turned ON and the pressed area 3*a* is detected preliminarily, then further pressing of the press area 3*a* turns the keytop 1 about the pivot shaft 1*a* to urge the push-button switch 6 into the ON state, and as a result, the pressed area 3*a* is detected ultimately.

Each symbol 3*b* is illuminated by light emitted from the corresponding light source 5 and transmitted through the keytop 1 so that the symbol 3*b* can be visually recognized even in the dark, for instance.

Incidentally, in the switch unit of the above construction, the pair of opposed contacts making up the membrane switch 2*a* is usually formed by print-coating a carbon paste or similar conductive paste on the top and bottom sheets 2*b* and 2*c*; that is, the membrane switch 2*a* is formed of a material which inhibits the passage therethrough of light.

Accordingly, the light emitted from the light source 5 mounted on the base plate 5 for illuminating the symbol 3*b* is cut off by the membrane switch 2*a* located right under the pressed area 3*a*, casting the shadow 3*c* of the membrane switch 2*a* onto the symbol 3*b* and hence preventing the symbol from being illuminated with a uniform brightness.

Since the surface sheet 3 and the membrane sheet 2 are held in close contact, the above phenomenon occurs inevitably no matter where the light source 5 is located. Accordingly, the conventional switch unit of FIGS. 1A, 1B and 1C is incapable of illuminating every symbol 3*b* with a uniform brightness.

On the other hand, in the case where two columns of press areas 3*a* are arranged in parallel to a pivot axis 1*b* of the keytop 1 as depicted in FIGS. 2A and 2B, the tactile feedback differs when the press areas 3*a* of the first column next to the pivot axis 1*b* are pressed and when the press areas 3*a* of the second column away from the pivot axis 1*b* are pressed.

FIGS. 3A and 3B show the state of the press areas 3*a* of the first and second columns being pressed, respectively. The difference in tactile feedback is attributable to the difference between the distances from the pivot axis 1*b* to the press areas 3*a* of the first and second columns; such nonuniform tactile feel is unwanted in terms of quality.

To provide uniform tactile feedback, the press areas 3*a* need to be aligned in parallel to the pivot axis 1*b*; in other words, uniformalization of tactile response does not allow free arrangement of the press areas, and hence imposes severe limitations on their arrangement.

Moreover, in the conventional switch unit the membrane sheet 2 and the surface sheet 3 are bonded together on the keytop 1, and in order to facilitate this bonding, the membrane sheet 2 and the surface sheet 3 are made smaller in outside shape than a concavity 1*c* of the keytop 1 for receiving them as shown in FIGS. 4A and 4B.

Accordingly, looking from the operating panel side of the switch unit, a clearance 7 is just visible between the marginal edge of the surface sheet 3 on all sides and the keytop 1—this impairs the appearance of the switch unit. Reference numeral 8 in FIGS. 4A and 4B denotes a case.

As a solution to this problem, it is possible to use such a structure as shown in FIGS. 5A and 5B, in which the surface sheet 3 is larger in outside shape than the concavity 1*c* of the keytop 1 and has its marginal portion downturned on all sides as indicated by 3*d* to completely cover the keytop 1.

In this instance, however, it is necessary to bond the surface sheet 3 to the membrane sheet 2 while bending the marginal portion of the former on all sides substantially at right angles thereto—this leads to difficulties in bonding the surface sheet 3 to the membrane sheet 2 in close contact therewith and in positioning the surface sheet 3.

Furthermore, in the conventional switch unit having the surface sheet 3 and the membrane sheet 2 bonded together in close contact with each other, when the top surface of the surface sheet 3 containing the symbols 3*b* is formed three-dimensional, curved or uneven, the surface of the keytop 1 which directly receives the membrane sheet 2 also needs to be formed in the same configuration as that of the surface sheet 3, but since it is extremely difficult to conform the membrane sheet 2 to the surface configuration of the keytop 1, it is practically impossible to make the top surface of the surface sheet 3 three-dimensional, curved or uneven.

SUMMARY OF THE INVENTION

It is therefore an object of the present invention to provide a tactile switch unit which: enables every symbol to be illuminated over the entire area thereof with uniform brightness; provides constant tactile response no matter which of arbitrarily arranged press areas is depressed; has an enhanced appearance; and permits easy implementation of the desired three-dimensional or similar surface configuration of the surface sheet.

According to the present invention, there is provided a tactile switch unit which comprises:

a case;

a link mechanism having first and second link members disposed in said case, rotatably supported intermediately of their ends to said case and having their inner ends rotatably coupled to each other;

a slider located above said link mechanism and vertically movably housed in said case, and having a flat top and a plurality of legs for rotatably supporting outer ends of said first and second links;

a membrane sheet disposed on said flat top of said slider and having formed therein a plurality of membrane switches;

a knob fixedly integrated with said slider and having apertures in its top panel fitted in a top opening of said case;

a surface sheet having formed thereon a plurality of press areas and disposed on the top panel of said knob with said press areas aligned with said apertures;

a pusher having a plurality of pusher elements disposed on said membrane sheet in opposing relation to the back of said press areas, respectively, each of said pusher elements being designed so that upon depression of said press area corresponding thereto, said each pusher element is pressed to urge said membrane switch corresponding thereto;

a tactile push-button switch disposed in said case and turned ON/OFF by pivotal movement of said link mechanism;

a bottom plate attached to said case on the bottom side thereof; and a light source mounted on the inside surface of said bottom plate, for illuminating a symbol provided in said each press area;

wherein said membrane sheet except a conductor portion and said pusher are formed of a light transmitting material.

In the above switch unit, at least one of the link mechanism and the slider may have a hole formed therethrough to pass light from the light source to each symbol.

In the above switch unit, the link mechanism may be provided with a third link member rotatably supported by either one of the first and second link members so that the push-button switch is turned ON/OFF by the third link member.

The above switch unit may be provided with storage means which stores ON information about the membrane switch turned ON by depression of the corresponding press area and from which the stored ON information is output upon turning ON of the push-button switch.

The above switch unit may have a construction in which each of said pusher elements has a cylindrical configuration with one end closed and is disposed with said closed end face opposite the back of said press area corresponding thereto, a protrusion for pushing said membrane switch being provided on the open end portion of said each pusher member at one side thereof and said open end portion being supported by a hinge on the side opposite from said protrusion.

In the above switch unit, the knob may be a molding with the surface sheet inserted therein.

DETAILED DESCRIPTION OF THE PREFERRED EMBODIMENTS

Figure 1A:
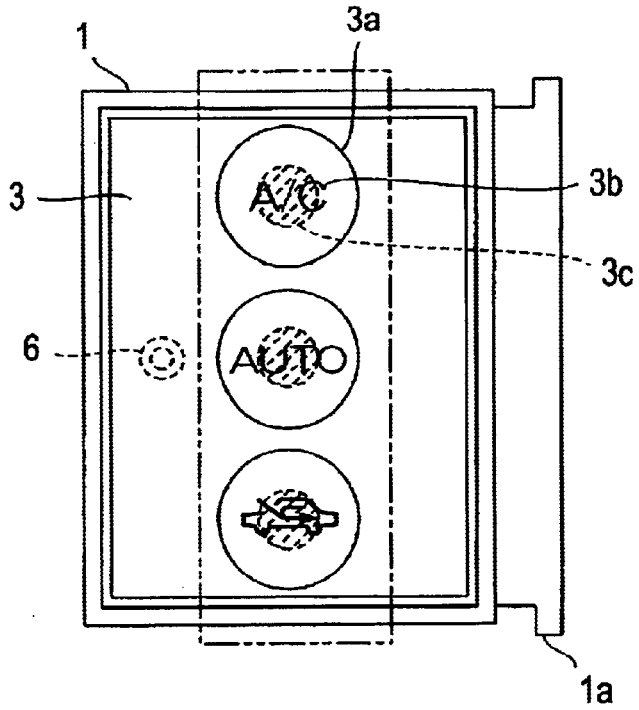
FIG. 1A PRIOR ART
FIG. 1A is a plan view showing a conventional tactile switch unit (with a single column of press areas)
Figure 1B:
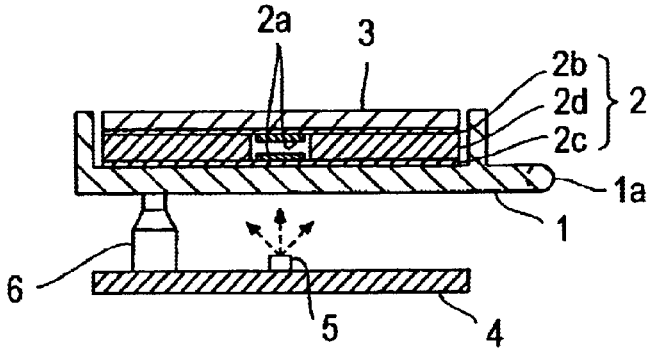
FIG. 1B PRIOR ART
FIG. 1B is its sectional view with no switch areas being pressed.
Figure 1C:
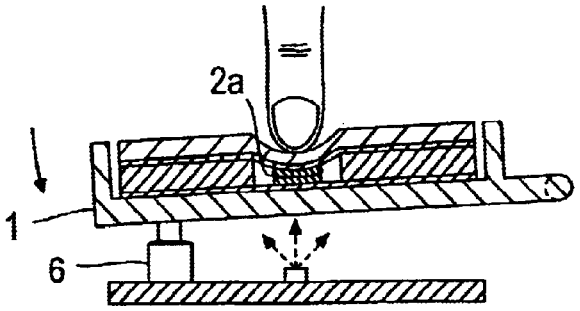
FIG. 1C PRIOR ART
FIG. 1C is its sectional view with one of the switch areas being pressed.
Figure 2A:
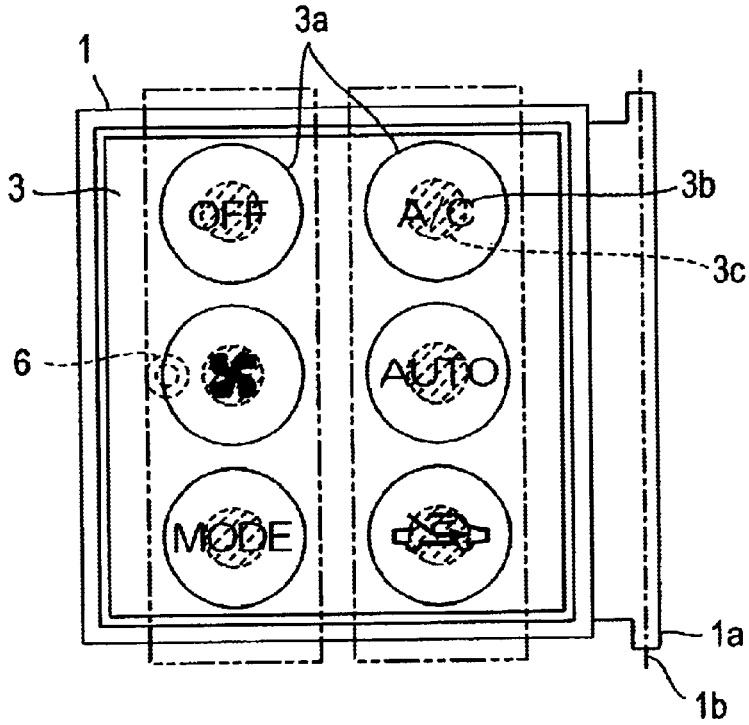
FIG. 2A PRIOR ART
FIG. 2A is a plan view showing a conventional tactile switch (with two columns of press areas)
Figure 2B:
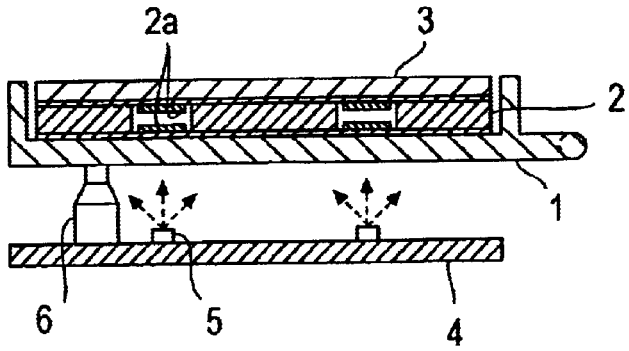
FIG. 2B PRIOR ART
FIG. 2B is a sectional view of FIG. 2A.
Figure 3A:
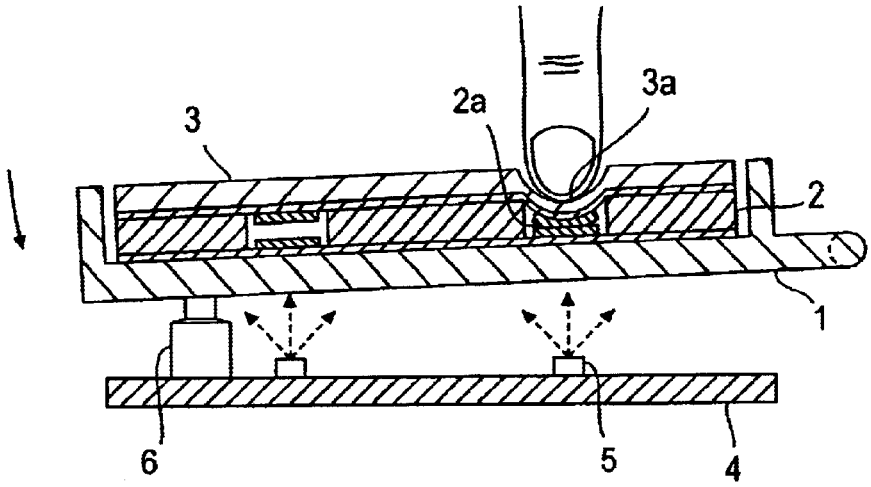
FIG. 3A PRIOR ART
FIG. 3A is a sectional view for explaining the operation when one of the press areas 3*a* of the one column is depressed.
Figure 3B:
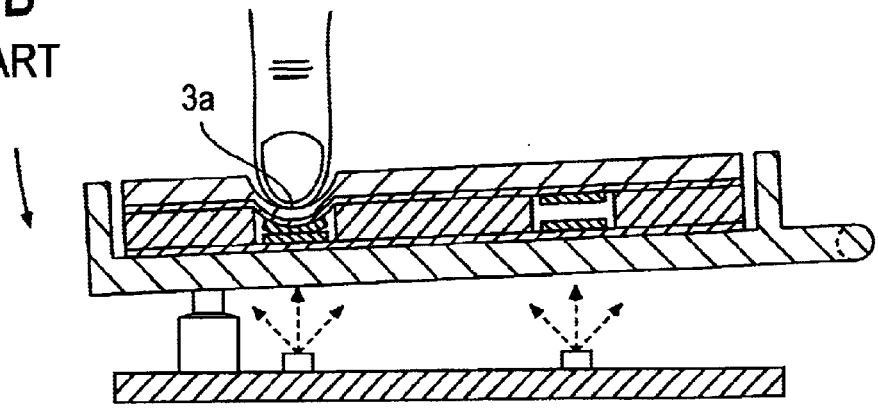
FIG. 3B PRIOR ART
FIG. 3B is a sectional view for explaining the operation when one of the press areas 3*a* in the other column is depressed.
Figure 4A:
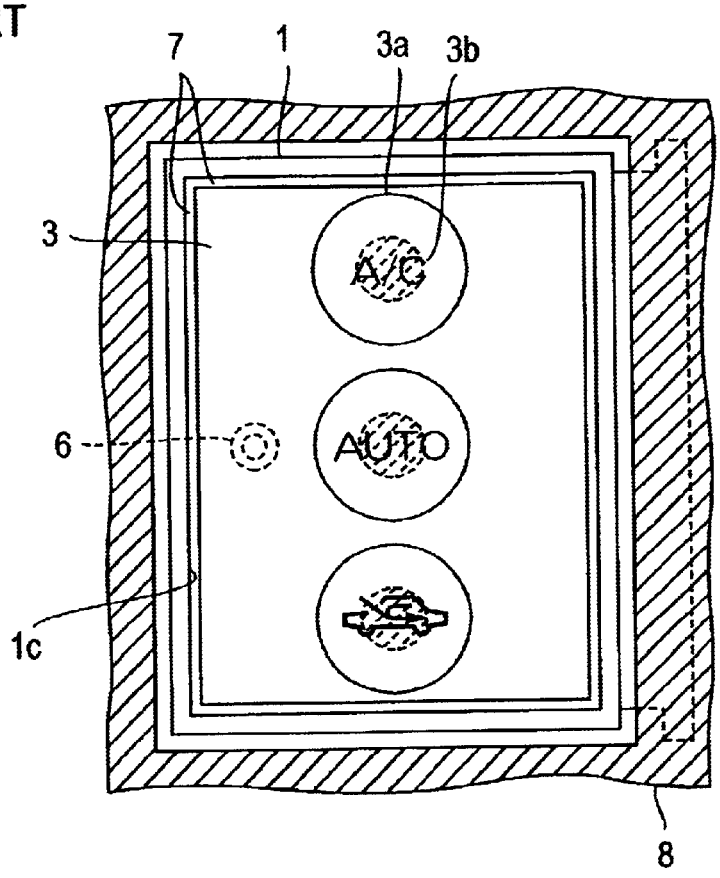
FIG. 4A PRIOR ART
FIG. 4A is a plan view for explaining a clearance between the surface sheet and the keytop of the conventional tactile switch unit.
Figure 4B:
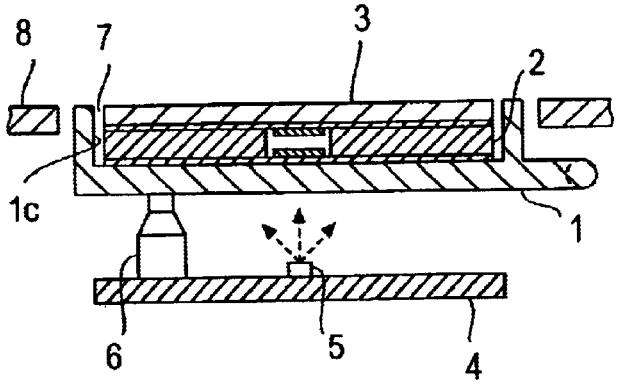
FIG. 4B PRIOR ART
FIG. 4B is a sectional view of FIG. 4A.
Figure 5A:
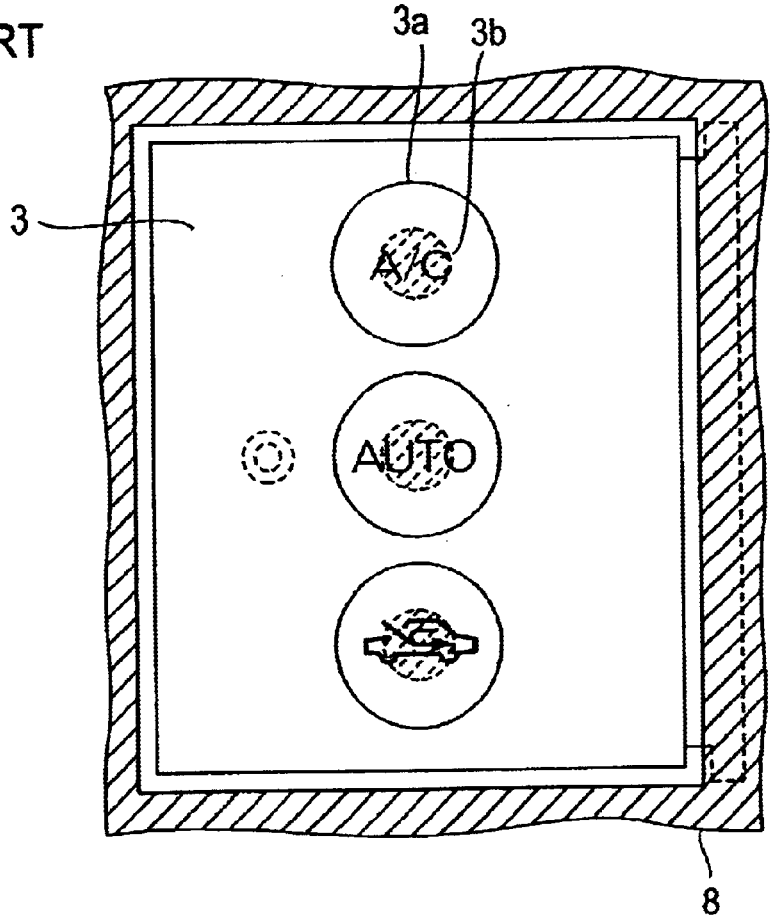
FIG. 5A PRIOR ART
FIG. 5A is a plan view showing another conventional tactile switch unit in which the surface sheet has its marginal portion downturned on all sides.
Figure 5B:
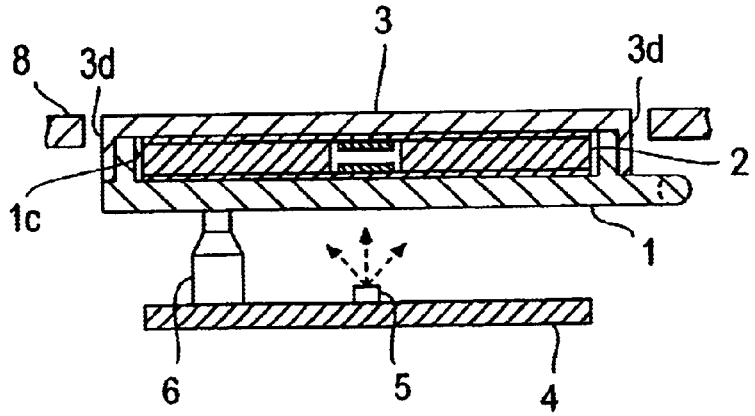
FIG. 5B PRIOR ART
FIG. 5B is a sectional view of FIG. 5A.
Figure 6A:
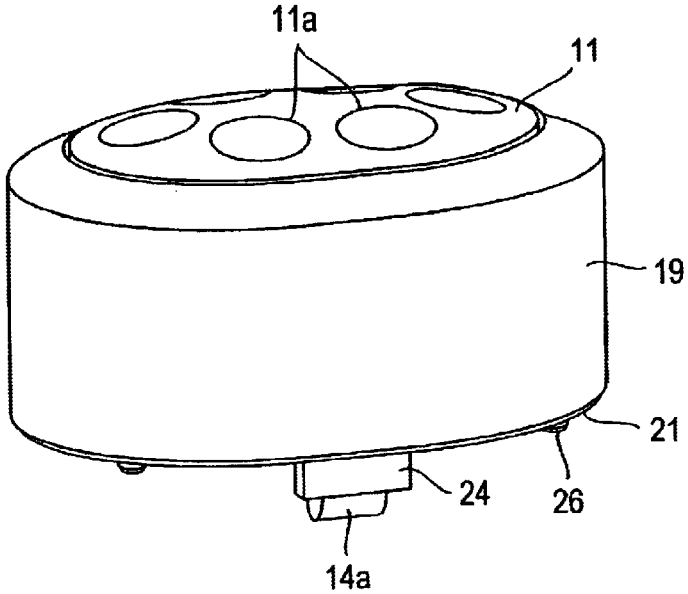
FIG. 6A is a perspective view illustrating an embodiment of the switch unit according to the present invention.
Figure 6B:
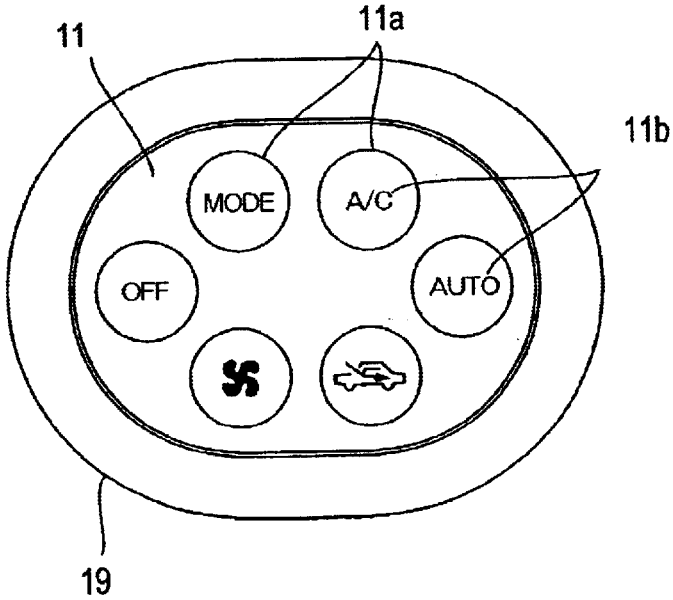
FIG. 6B is its plan view.
Figure 7:
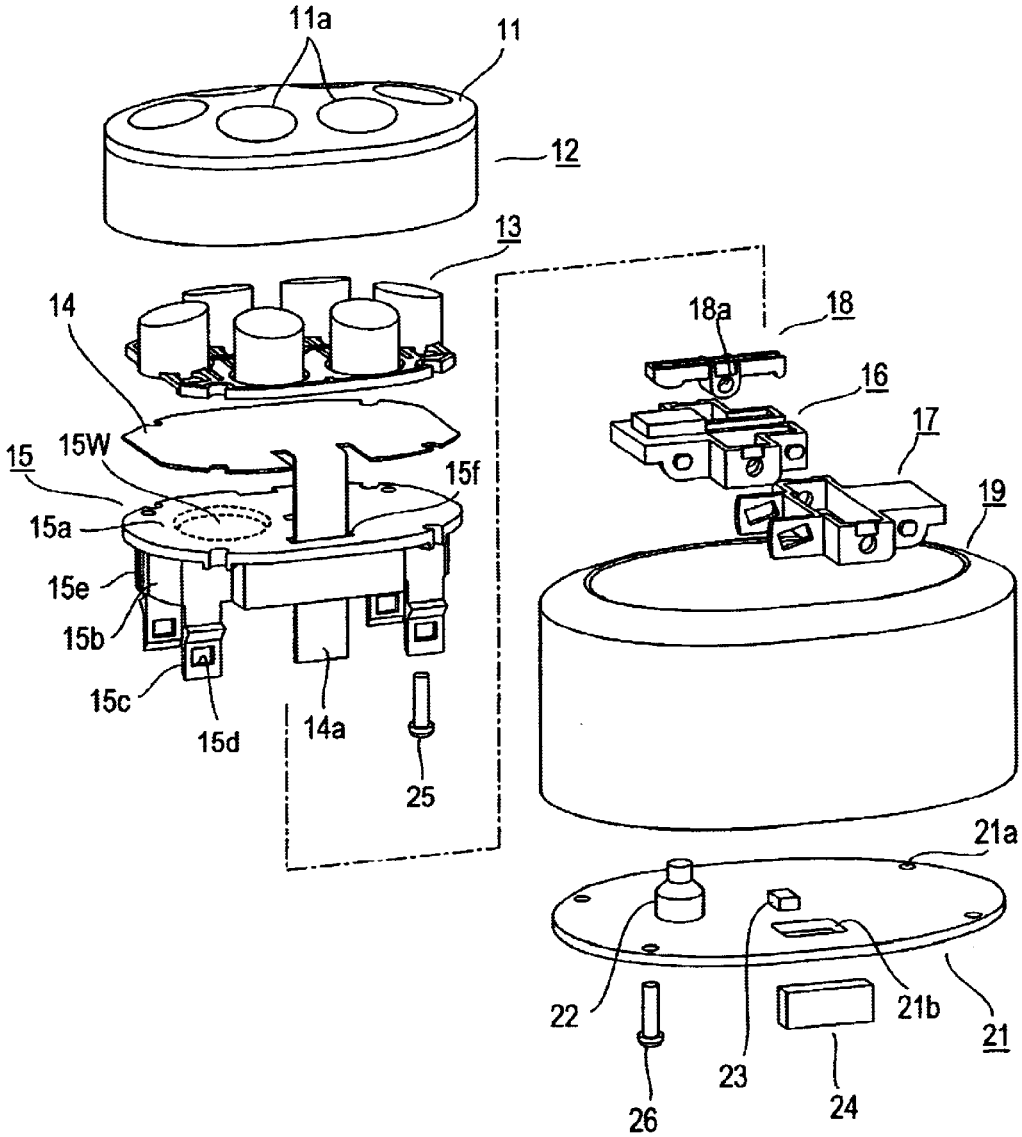
FIG. 7 is an exploded perspective view of the FIG. 6A embodiment.

FIGS. 6A and 6B are external views of an embodiment of the tactile switch unit according to the present invention, and FIG. 7 is its exploded view. In the illustrated example the switch unit comprises: a surface sheet 11 and a knob 12 formed in one-piece structure; a pusher 13; a membrane sheet 14; a slider 15; links 16 to 18; a case 19; a bottom plate 21; a push-button switch 22; a light source 23; a connector 24; and screws 25 and 26. FIGS. 8 through 12 depict in detail the case 19, the link member 16, the link member 17, the knob 12 integral with the surface sheet 11, and the pusher 13, respectively. A description will be given first, with reference to FIGS. 7 to 12, of the constructions of the respective parts.

Figure 8:
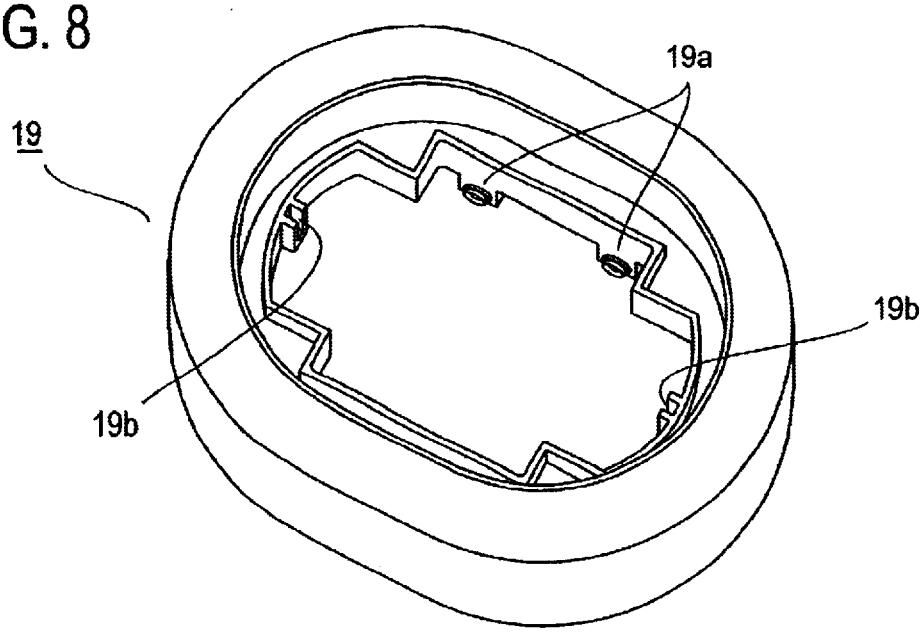
FIG. 8 is a perspective view showing in detail a case in FIG. 7

FIG. 8 shows the case 19 in this example, which is elliptic in outside shape and open at both of the top and the bottom and has a pair of stub shafts 19*a* protrusively provided on either of opposed flat inner walls of the elliptic structure. Further, on the inner wall of the case 19 there are provided vertically extended rail grooves or guides 19*b* at three locations.

Figure 9:
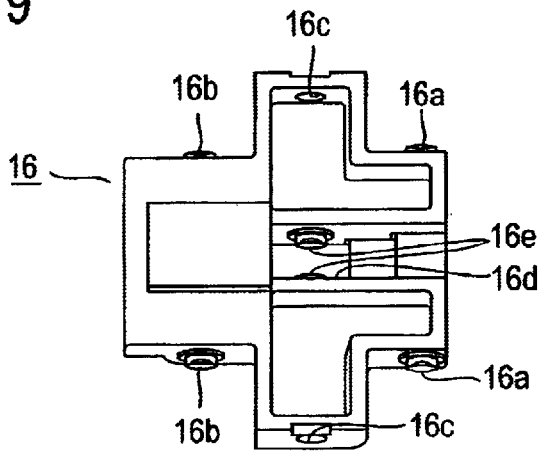
FIG. 9 is a perspective view showing in detail a link member 16 in FIG. 7.

FIG. 9 shows the link member 16, which is wide and has stub shafts 16*a* protrusively provided on opposite outer sides of its one end portion and similar stub shafts 16*b* on opposite outer sides of the other end portion. The intermediate portion of the link member 16 is formed wider and has holes 16*c* formed through its opposite wall portions.

The link member 16 has an opening 16*d* formed through the intermediate portion centrally thereof. On the opposite inner wall surfaces partitioning the opening 16*d* widthwise thereof there are protrusively provided stub shafts 16*e* projecting inwardly toward each other. Incidentally, the opening 16*d* is open at the top on the side toward the one end portion of the link member 16 (on the side of the stub shafts 16*a*) and at the bottom on the side toward the other end portion.

Figure 10:
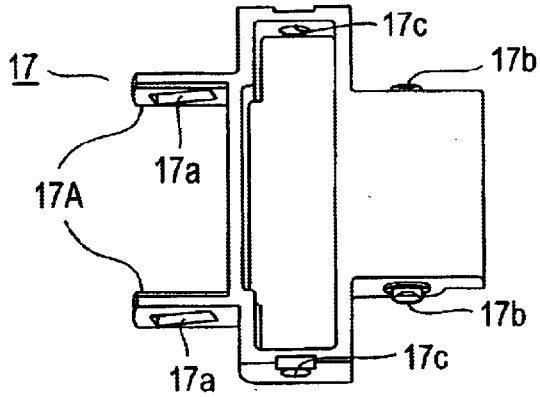
FIG. 10 is a perspective view showing in detail a link member 17 in FIG. 7

FIG. 10 shows the link member 17, which is formed wide as is the case with the link 16 member and has a pair of arms 17A extending from one side, each arm 17A having formed therethrough a square hole 17*a*. On opposite outside surfaces of the link member 17 on the other side there are protrusively provided stub shafts 17*b*. Further, the link member 17 has holes 17*c* formed through opposite end walls of the intermediate portion.

The link member 18 is arm-shaped and has a hole 18*a* formed therethrough intermediately of its ends as depicted in FIG. 7.

The slider 15 has its top formed by an elliptic flat top 15*a* as depicted in FIG. 7. The flat top 15*a* is mounted on a base 15*b*, from which four legs 15*c* are extended downwardly. The legs 15*c* are extended from the marginal edge of the base 15*b* at four places, and each leg 15*c* has a square hole 15*d* formed through its tip end portion. On the peripheral surface of the base 15*b* there are protrusively provided rails 15*e* at positions corresponding to the three rail grooves or guides 19*b* of the case 19 shown in FIG. 8.

The surface sheet 11 molded integral with the knob 12 is elliptic in this example as shown in FIGS. 7 and 8, and has six circular press areas 11*a* arranged at substantially equal intervals circumferentially of the ellipse. The press areas 11*a* have such symbols 11*b* as depicted in FIG. 6B, which are formed by printing letters and pictures as watermarks so that they glow when irradiated with light.

Figure 11:
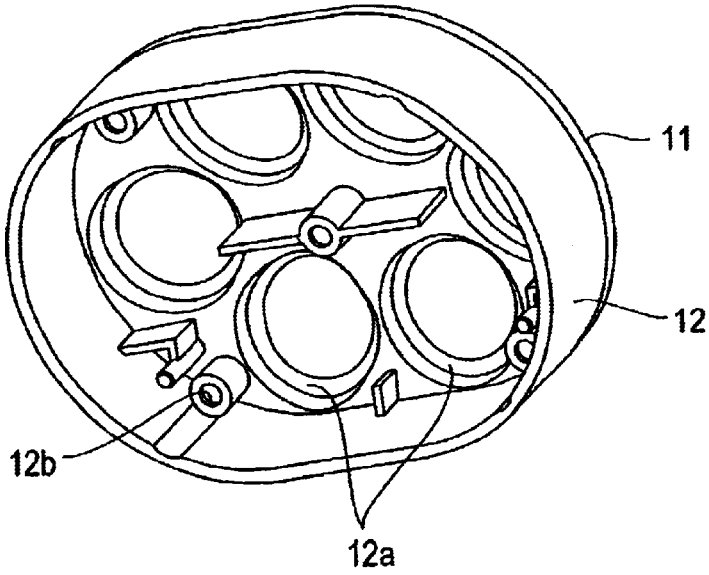
FIG. 11 is a perspective view showing in detail a knob having formed integrally therewith a surface sheet in FIG. 7.

As shown in FIGS. 11, the knob 12 is an elliptic cylinder open at the bottom and has six apertures 12*a* formed in the closed other end face (i.e., the top panel) at positions corresponding to the press areas 11*a* of the surface sheet 11, respectively. The surface sheet 11 is mounted on the top panel of the knob 12 so that the six press areas 11*a* cover the apertures 12*a*.

Such a unitary structure of the knob 12 and the surface sheet 11 is obtained, for example, by molding the knob 12 with the surface sheet 11 inserted therein. The knob 12 and the surface sheet 11 are both formed of polycarbonate, for instance. In FIG. 11, reference numeral 12*b* denotes screw holes, which are provided at the center and four corners of the knob 12.

Figure 12:
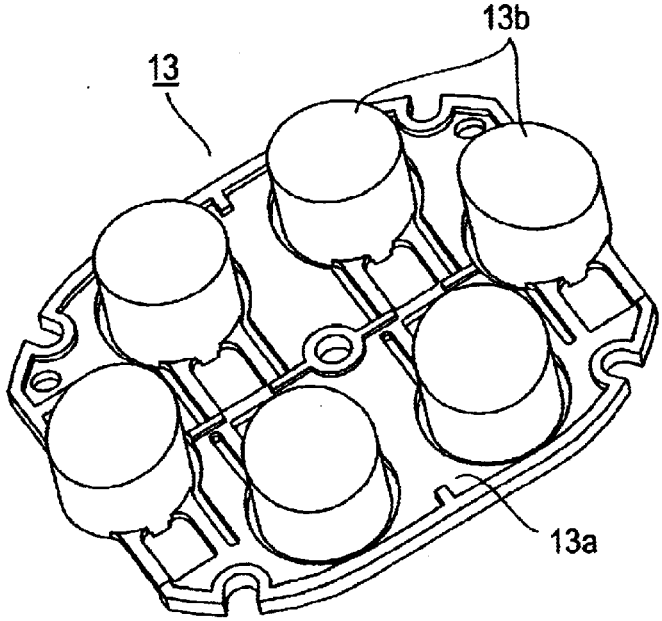
FIG. 12 is a perspective view showing in detail a pusher in FIG. 7.

As depicted in FIG. 12, the pusher 13 has a base 13*a* and six pusher elements 13*b* protrusively provided thereon at positions corresponding to the six apertures 12*a* formed through the top panel of the knob 12. The configuration of the pusher elements 13*b* will be described in detail later on. Assembly of the switch unit comprises a total of four steps of knob assembling, link assembling, bottom-plate assembling and assembling of the subassemblies as described below.

<Knob Assembling>

The pusher 13, the membrane sheet 14 having formed therein a required number of membrane switches and the slider 15 are inserted into the knob 12 with the surface sheet 11 formed integrally therewith and are fastened by the screws 25 (see FIG. 7) to form a one-piece structure. The screws 25 are threaded into the five tapped holes 12*b* of the knob 12.

The membrane sheet 14 is mounted on the flat top 15*a* of the slider 15, and the base 13*a* of the pusher 13 is disposed on the membrane sheet 14. The pusher 13 is disposed with its pusher elements 13*b* held in the apertures 12*a* of the knob 12 so that their top end faces just underlie the press areas 11*a* of the surface sheet 11.

<Link Assembling>

The link member 18 is incorporated in the link member 16. The link member 18 is rotatably mounted in the link member 16 with the hole 18*a* of the former receiving the pair of stub shafts 16*e* (see FIG. 9) of the latter. The pair of stub shafts 16*a* of the link member 16 are fitted into the pair of square holes 17*a* of the link member 17 (see FIG. 10). Thus the link members 16 and 17 have their inner ends rotatably coupled to each other.

<Bottom-Plate Assembling>

On the top of the bottom plate 21 are mounted the push-button switch 22 and the light source 23 as depicted in FIG. 7. On the underside of the bottom plate 21 is mounted the connector 24. Incidentally, there are not shown in FIG. 7 a resistor and similar electrical parts for controlling current flowing through the light source 23. At the four corners of the bottom plate 21 there are formed therethrough tapped holes 21*a* for receiving the screws 26 As the light source 23 may properly used a light emitting diode (LED), a laser diode (LD), or a lamp. In FIG. 7 the light source 23 is shown to be a laser diode.

<Assembling of Subassemblies>

In the first place, the knob assembly and the link assembly are incorporated into the case 19. The link members 16 and 17 have their pairs of holes 16*c* and 17*c* (FIG. 9) engaged with the pair of opposed stub shafts 19*a* (FIG. 8) on the inner wall of the case 19. By this, the link members 16 and 17 are rotatably supported by the case 19.

On the other hand, the knob assembly is incorporated in the case 19 with the three rails 15*e* of the slider 15 inserted in the rail grooves 19*e* provided on the inner wall of the case 19; the knob assembly is vertically movably supported in the case 19

The stub shafts 16*b* and 17*b* of the links 16 and 17 are fitted into the pairs of square holes 15*d* of the opposed legs 15*c* of the slider 15 overlying the link members 16 and 17. By this, the link members 16 and 17 have their outer ends rotatably held by the legs 15*c* of the slider 15.

Next, the bottom-plate assembly is disposed on the side of the open end portion of the case 19 and fastened thereto by the screws 26 which are screwed into the tapped holes 21*a* formed through the bottom plate 21 at four locations as referred to above. The membrane sheet 14 has its tail 14*a*, as shown in FIG. 7, extended through slit openings 15*f* and 21*b* in the slider 15 and the bottom plate 21 and inserted in the connector 24 mounted on the underside of the bottom plate 21 to establish electrical connections between respective membrane switches 14*e* and the connector 24.

By such assembling steps, the switch units depicted in FIGS. 6A and 6B is completed. The top panel of the knob 12 covered with the surface sheet 11 is fitted in the top open end portion of the case 19.

Figure 13:
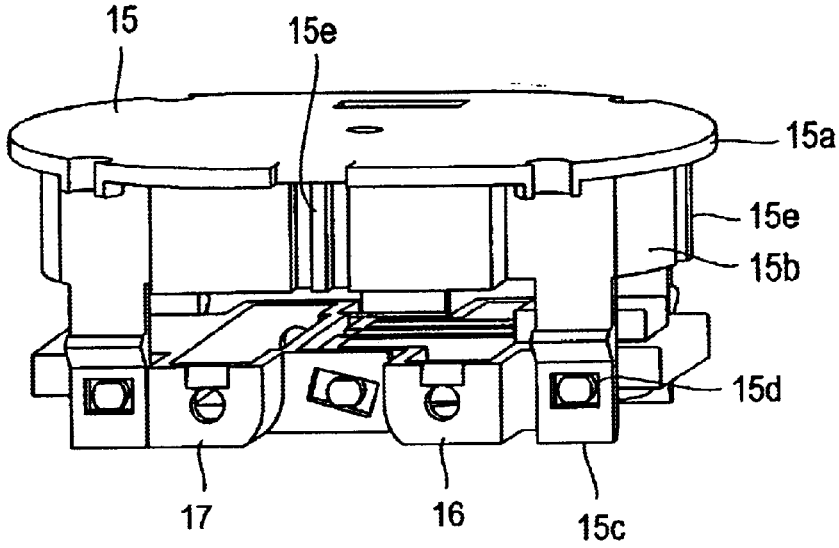
FIG. 13 is a perspective view showing the state of coupling between a slider and a link mechanism.
Figure 14:
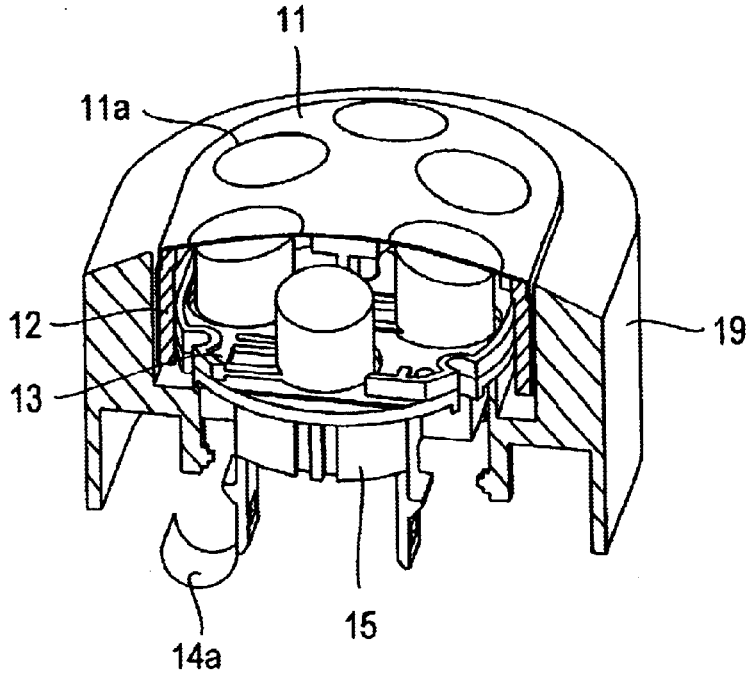
FIG. 14 is a partly-cut-away sectional view of FIG. 6A.

FIG. 13 depicts the state of coupling between the slider 15 and the link members 16 and 17. FIG. 14 shows in section the upper part of the switch unit, inclusive of the slider 15. In FIGS. 14, 6A and 7 there not shown the symbols 11*b* formed in the press areas 11*a* of the surface sheet 11.

In the switch unit of the above configuration, the link mechanism composed of the link members 16 to 18, the slider 15, the pusher 13 and the membrane sheet 14 except conductor portions, that is, the top and bottom sheets 14*b* and 14*c* forming the membrane sheet 14, and a spacer 14*d* (see FIGS. 15A and 15B) are formed of a light transmitting material. The link members 16 to 18, the slider 15 and the pusher 13 are formed of, for example, transparent ABS resins.

Next, a description will be given of the operation of the switch unit when one of the press areas 11*a* is depressed.

Figure 15A:
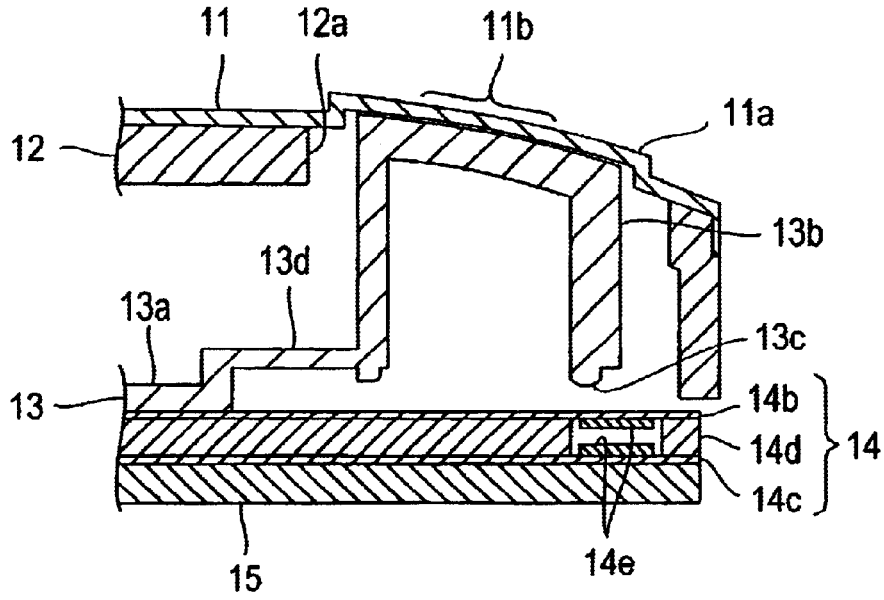
FIG. 15A is a sectional view showing the relationship between a pusher element 13*b* and a membrane switch 14*e* when the former is not depressed.

Referring first to FIG. 15A, the construction of one of the pusher elements 13*b* of the pusher 13 will be described below. The pusher element 13*b* is, in this example, a cylindrical member closed at one end and its top is formed by the closed end face. The circumferential end face of the open end portion of the pusher element 13*b* is partly protruded as indicated by 13*c*, and the lower end portion on the opposite side from the protrusion 13*e* is supported to a base portion 13*a* through a hinge portion 13*d*.

Figure 15B:
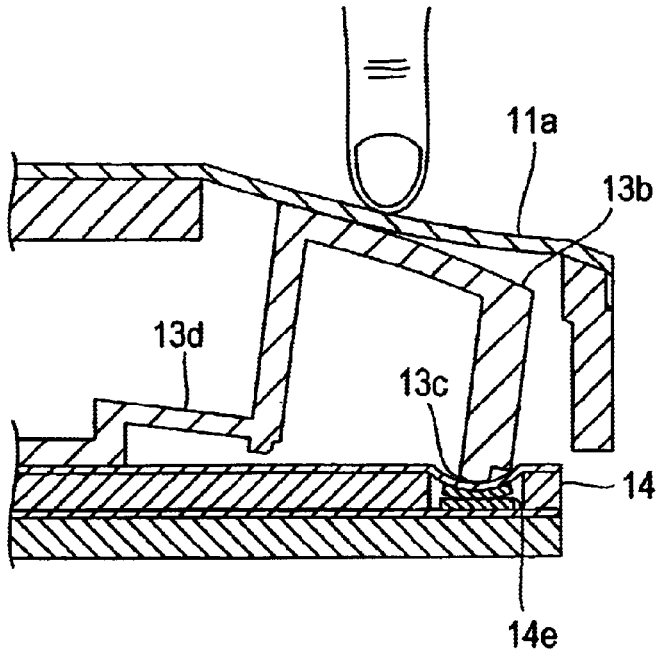
FIG. 15B is a sectional view showing their relationship when the pusher element 13*b* is depressed.

On depression of the press area 11*a*, the underlying surface sheet 11 bends and presses the pusher element 13*b* of the pusher 13 as depicted in FIG. 15B. Since the pusher element 13*b* is supported by the hinge portion 13*d* capable of elastic deformation, the hinge portion 13*d* bends and the pusher element 13*b* tilts (turns), urging the protrusion 13*c* against the membrane sheet 14. The opposed contacts of the membrane switch 14*e* are pressed into contact with each other, turning ON the membrane switch 14*e*.

Even after turning ON of the membrane switch 14*e*, the press area 11*a* is still kept on being pressed, by which the slider 15 is guided down by the rail grooves 19*b* of the case 19.

Figure 16A:
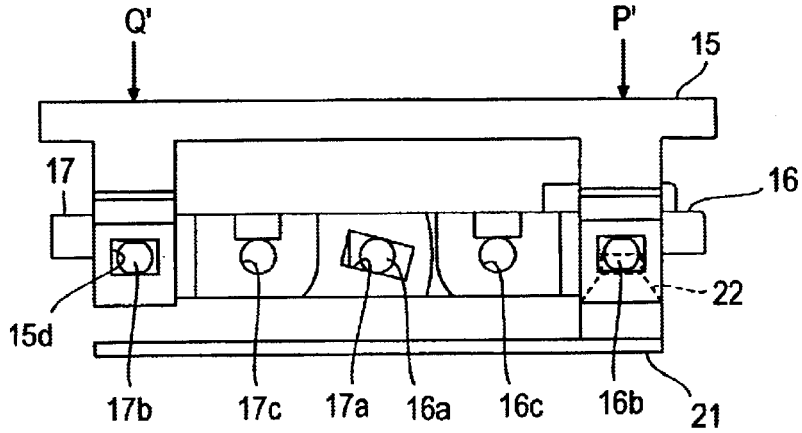
FIG. 16A is a schematic diagram showing the relationships among a slider 15, link members 16 and 17, a bottom plate 21 and a push-button switch 22 when the button is not actuated.
Figure 16B:
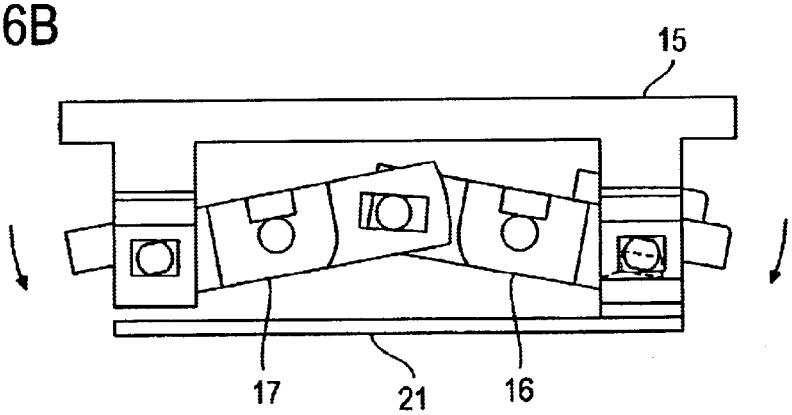
FIG. 16B is a schematic diagram showing their relationships when the button is actuated.
Figure 17A:
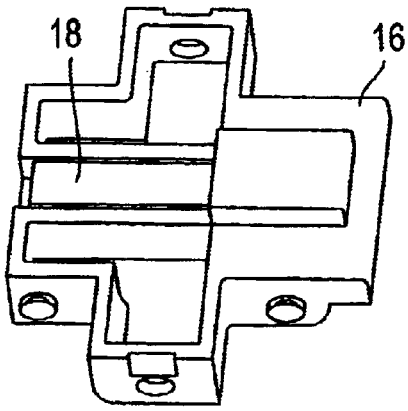
FIG. 17A is a perspective view showing how the link member 18 is incorporated in the link member 16.
Figure 17B:
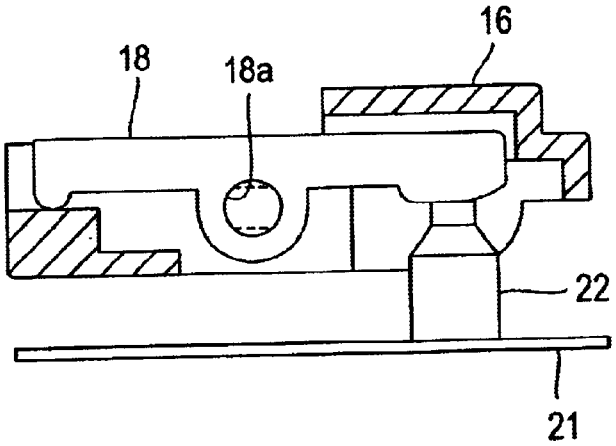
FIG. 17B is a schematic diagram showing the state of the link member 18 when the push-button switch 22 is not actuated in FIG. 16.
Figure 17C:
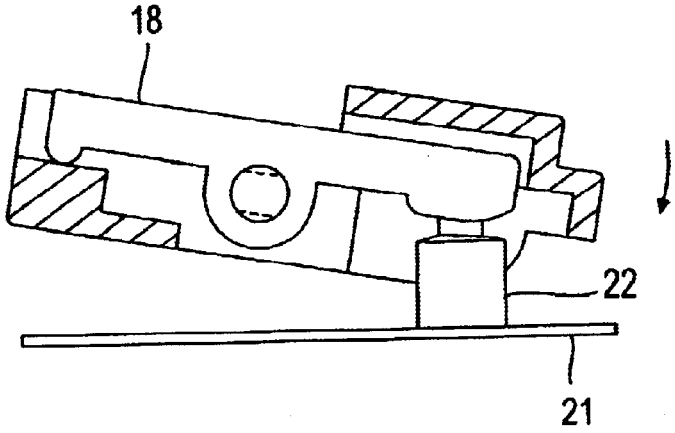
FIG. 17C is a schematic diagram showing the state in which the push-button switch 22 is actuated by the link member 18.

As the slider 15 moves down, the link members 16 and 17 normally in the state shown in FIG. 16B turns clockwise and counterclockwise, respectively, and the link member 18 incorporated in the link member 16 as depicted in FIG. 17A, which is normally in the state shown in FIG. 17B, also turns clockwise as depicted in FIG. 17*c*.

The push-button switch 22 is located on the outer end portion of the link member 18 and held in abutment with the link member 18 alone as depicted in FIG. 17B, and the outer end portions of the link member 18 are not in contact with the link member 16. On the other hand, the inner end portion of the link member 18 is supported by the inner end portion of the link member 16. Accordingly, upon applying a clockwise torque to the link member 16, the link member 18 also turns clockwise, urging its outer end portion against the push-button switch 22 to turn it ON, providing tactile response.

Next, a description will be given of each feature of the switch unit according to the present invention which has the above construction and operates as described above.

(1) Illumination of Symbols

The link members 16 to 18, the slider 15, the pusher 13 and the membrane sheet 14 except its conductor portions (the membrane switches 14*e* and a printed pattern) are formed of a light transmitting material, and unlike in the conventional switch unit, the surface sheet 11 and the membrane sheet 14 are not held in close contact with each other, but instead the pusher 13 is interposed between them. Accordingly, the light emitted from the light source 23 reaches each symbol 11*b* without being cut off. This ensures illumination of each symbol 11*b* with a uniform brightness.

Incidentally, the membrane switch 14*e*, which is pressed by the protrusion 13*c* of the pusher element 13*b* of the pusher 13, is usually formed of a material which is not transparent to light, but in this example, as depicted in FIGS. 15A and 15B, the membrane switch 14*e* is located outside the marking 11*b* as viewed from the operating panel—this also helps good illumination of the symbol 11*b*.

For example, even in the case where the membrane sheet 14 is so limited in space that the membrane switch 14*e* or printed pattern is required to be provided right under the symbol 11*b* as viewed from the operating panel, since the pusher becomes a light conductor, every symbol 11*b* can be illuminated with a uniform brightness even if the light from the light source 23 is cut off by the membrane switch 14*e* or printed pattern.

(2) Tactile Feel

Upon depression of one of the plurality of press areas 11*a*, the slider 15 is also depressed at the portion corresponding to the depressed press area 11*a*, and in association with the downward movement of the slider 15 the link members 16 and 17 turn, by which the four legs 15*c* at the four corners of the slider 15 are pushed down uniformly. Hence, no matter which press area 11*a* is depressed, the slider 15 is uniformly translated.

This embodiment uses, in addition to the link members 16 and 17, the link member 18 to turn ON/OFF the push-button switch 22. The following description will be given on the assumption that the link members 16, 17 and 18 have substantially the same length T and turn about their centers, respectively.

Figure 18A:
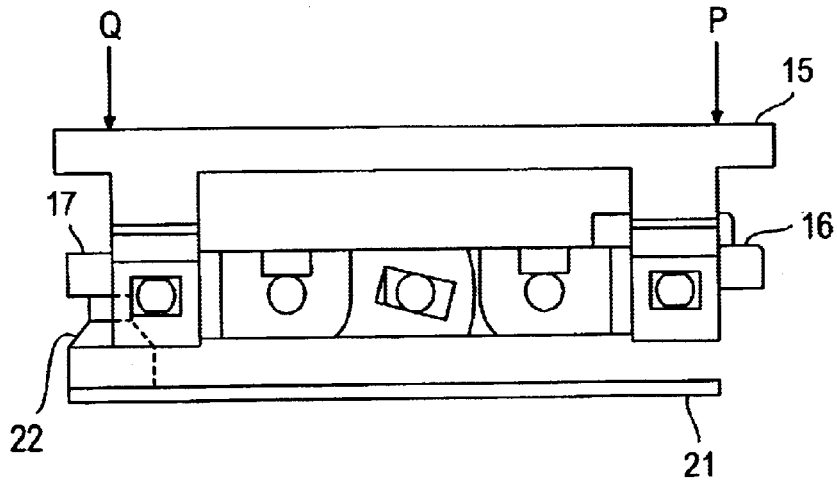
FIG. 18A is a schematic diagram showing the relationships among the slider 15, the link members 16 and 17, the bottom plate 21 and the push-button switch 22 when the switch is not actuated.
Figure 18B:
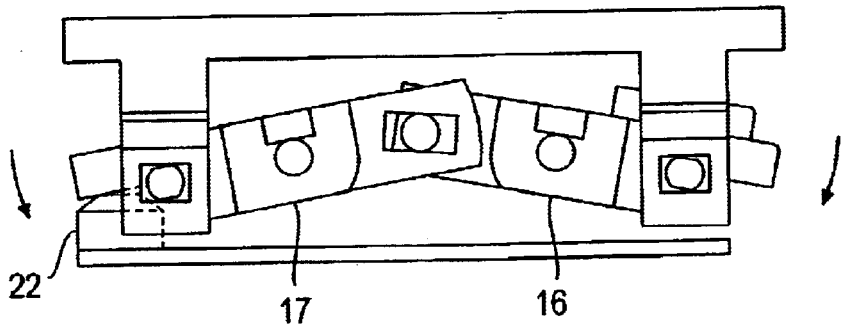
FIG. 18B is a schematic diagram showing their relationships when the switch is actuated.

Now, consider, for example, the case where the link member 18 is not used and the push-button switch 22 is disposed under the outer end portion of the link member 17 as shown in FIGS. 18A and 18B. In this instance, assuming that the press area 11*a* (see FIG. 14, for instance) near the outer end of the link member 16 is depressed and the slider 15 is urged at a point P, the force applied to the point P drives the push-button switch 22, for example, through the two link members 16 and 17 of the length T, and consequently, the flexure (or rigidity) of the two links 16 and 17 affects the tactile feedback that the push-button switch 22 gives. On the other hand, when the slider 15 is pressed at a point Q, the rigidity of the link members 16 and 17 do not influence the tactile response of the push-button switch 22 since it is located right under the point Q.

When the rigidity of the link members 16 and 17 is high, the push-button switch 22 provides substantially the same tactile feedback when the slider 15 is depressed at the points P and Q, respectively. When the rigidity of the link members 16 and 17 is low, however, tactile response to the pressing of the slider 15 at the points P and Q differs, raising a problem in terms of quality. Incidentally, as the switch unit becomes larger, the link members 16 and 17 also inevitably become larger and their rigidity decreases accordingly.

In contrast thereto, according to the structure which uses the link member 18 as depicted in FIGS. 17A and 17B, when the slider 15 is urged at a point P' as shown in FIG. 16A, the push-button switch 22 is actuated through the two link members 16 and 18, while at the same time the link member 17 turns. When the slider 15 is pushed 15 at a point Q', since the inner end portion of the link member 17 is supported to the inner end portion of the link member 16 which is torqued by the inner end portion of the link member 17, the length of the link member 16 can be ignored and hence the push-button switch 22 can be regarded as being actuated through the two link members 17 and 18.

Accordingly, even if the slider 15 is pressed at the point P' or Q', the push-button switch 22 is actuated through the two link members 16 and 18 or 17 and 18; therefore, if the link members 16, 17 and 18 possess similar rigidity, pressing the slider 15 at the points P' and Q' provides substantially the same tactile feedback. Hence, the switch unit provides more uniform tactile feedback over the plurality of press areas 11*a* than in the case where the link member 18 is not used.

Further, this enables the press areas 11*a* to be freely arranged anywhere on the operating panel surface (the surface of the surface sheet 11), providing increased flexibility in the arrangement of the press areas 11*a*.

Figure 19A:
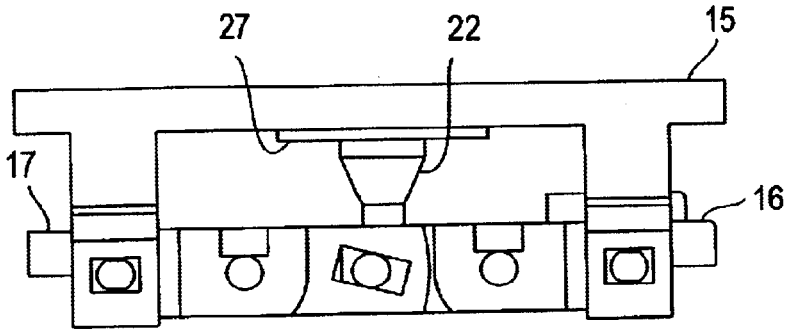
FIG. 19A is a schematic diagram showing the relationships among the slider 15, the link members 16 and 17, the bottom plate 21 and the push-button switch 22 disposed on the inner end of the link member 16 when the switch is not actuated.
Figure 19B:
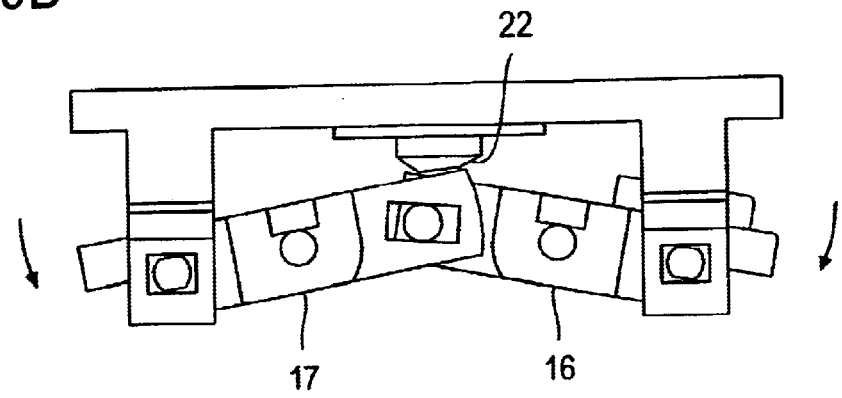
FIG. 19B is a schematic diagram showing the relationships among the slider 15, the link members 16 and 17, the bottom plate 21 and the push-button switch 22 disposed on the inner end of the link member 16 when the switch is actuated.

Of course, the present invention is not limited specifically to the switch unit provided with the link member 18 but is applicable to a switch unit without the link member 18 as shown in FIGS. 16A and 16B. In this instance, the push-button switch 22 may also be disposed, for example, on the inner end of the link member 16, that is, on the underside of the slider 15 as depicted in FIGS. 19A and 19B. This structure requires, in addition to the bottom plate 21, a base plate 27 for mounting the push-button 22 and hence increases the number of parts used.

(3) Configuration of Symbol Bearing Surface

Since the pusher elements 13*b* of the pusher 13 are each interposed between one of the press areas 11*a* of the surface sheet 11 and the membrane sheet 14, when the symbol bearing surface (the surface of the surface sheet 11) where the symbol 11*b* is provided is configured three-dimensional curved, or uneven, the top of the pusher element 13*b* can be configured correspondingly.

Since the membrane switch 14*e* is pressed by the protrusion 13*c* on the lower end of the pusher element 13*b*, the configuration of the top of the pusher element 13*b* does not ever affect the membrane switch 14*e*, and the membrane sheet 14 need not be configured three-dimensional or so as in the conventional switch unit, and the surface of the flat top 15*a* of the slider 15 may be flat or planar.

Accordingly, the symbol bearing surface can easily be configured as desired, for example, three-dimensional or curved.

Figure 20A:
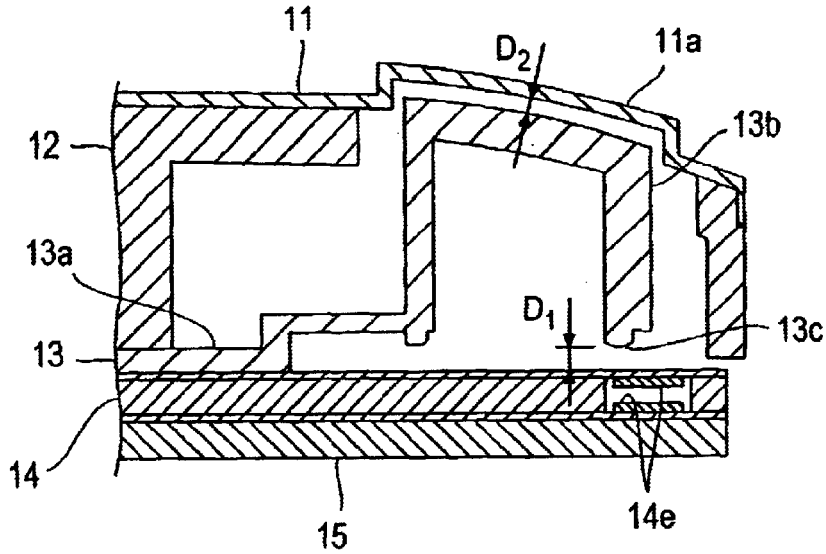
FIG. 20A is a sectional view for explaining the positional relationships among a press area 11*a*, a pusher element 13*b* and a pusher protrusion 13*c;*
Figure 20B:
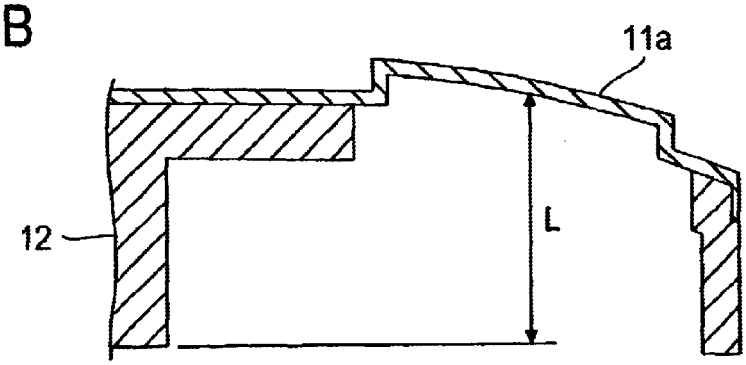
FIG. 20B is a diagram for explaining the height of the press area 11*a;*
Figure 20C:
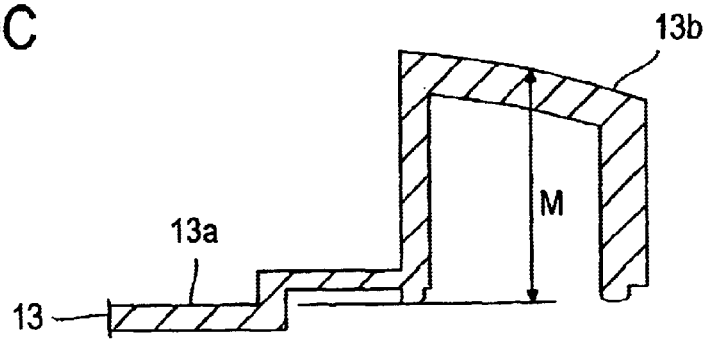
FIG. 20C is a diagram for explaining the height of the pusher element 13*b;*

Turning next to FIGS. 20A, 20B and 20C, a description will be given of the accuracy of important dimensions.

The accurate provision of spacing $D_1$ between the protrusion 13*c* of the pusher element 13*b* and the surface of the membrane sheet 14 and spacing $D_2$ between the interior surface of the press area 11*a* of the surface sheet 11 and the top of the pusher element 13*b* of the pusher 13 is very important for quickly and accurately turning ON the membrane switch 14*e*.

In the illustrated example, as depicted in FIG. 20A, the pusher 13 is fixed to the slider 15 through the membrane sheet 14, that is, the underside of the base 13*a* of the pusher 13 and the surface of the membrane sheet 14 ca be closely contacted.

With this structure, the spacing $D_1$ between the protrusion 13*e* of the pusher element 13*b* and the surface of the membrane sheet 14 can be defined by the spacing between the underside of the base 13*a* and the protrusion 13*c* of the pusher 13 alone. Since the spacing $D_1$ can be defined by one dimension, no accumulation of dimensional tolerances will occur and the spacing $D_1$ can easily be set as intended with high accuracy.

On the other hand, as depicted in FIG. 20A, the knob 12 is fixed to the slider 15 through the pusher 13 and the membrane sheet 14, that is the underside of the knob 12 and the top of the base 13*a* of the pusher 13 can be closely contacted.

The spacing between the underside of the knob 12 and the interior surface of the press area 11*a* can be defined, as shown in FIG. 20B, by one dimension (indicated by L) using the underside of the knob 12 as the reference. Further, using the underside of the knob 12 (the top of the base 13*a* of the pusher 13) as reference, the spacing between the top of the pusher element 13*b* and the top of the base 13*a* of the pusher 13 can be defined by one dimension (indicted by M) as shown in FIG. 20C.

Accordingly, the spacing $D_2$ between the interior surface of the press area 11*a* and the top of the pusher element 13*a* of the pusher 13 is $D_2$=L−M, and the spacing $D_2$ is an accumulative tolerances of the two dimensions L and M, that is, the tolerance accumulation is minimum. Hence, the spacing $D_2$ can easily be set with high accuracy.

Figure 21:
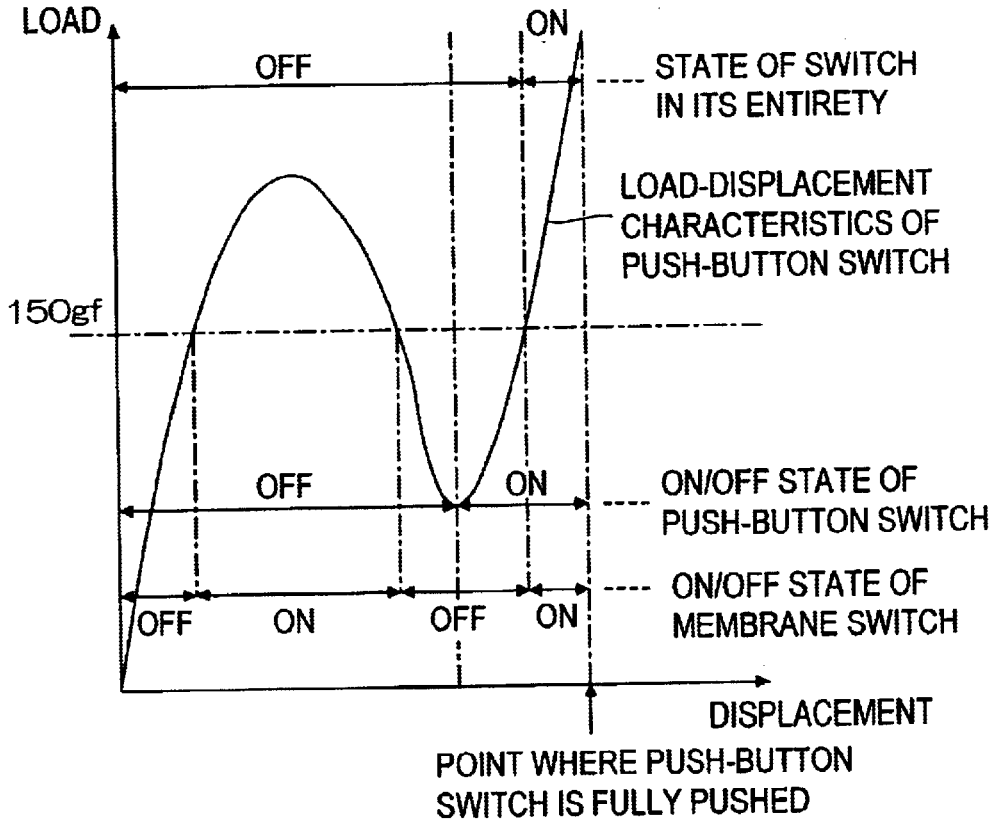
FIG. 21 is a graph showing the load-displacement characteristics of the push-button switch and the ON/OFF state of the membrane switch and the push-button switch.

Referring next to FIG. 21, a description will be given of the relationship between the turning-ON timing of the membrane switch 14*e* and the turning-ON timing of the tactile feel push-button switch 22.

FIG. 21 is a graph showing the load-displacement characteristics of the push-button switch 22, depicting by way of example the ON/OFF state of the push-button switch 22 and the ON/OFF state of the membrane switch 14*e*.

As seen from FIG. 21, according to the load-displacement characteristics of the push-button switch 22, the membrane switch 22 once turned ON by depression may sometimes be turning OFF prior to turning ON of the push-button switch 22. This will be described below in detail.

Assume, for example, that a 150-gf pressure or load is needed to turn ON the membrane switch 14*e*. In the load-displacement characteristics of the push-button switch 22 there is a drop in load upon generation of a "click" touch, and when the load falls below 150 gf, the membrane switch 14*e* turns OFF. That is, the push-button switch 22 turns ON after turning OFF of the membrane switch 14*e*.

After turning ON of the push-button switch 22 the load begins to increase, and when the load exceeds 150 gf, the membrane switch 14*e* turns ON again, bringing the switch into the ON state in its entirety.

In this case, the timing for the push-button switch 22 to produce the "click" touch does not coincide with the timing for the switch to turn ON as a whole; consequently, the switch unit cannot provide a comfortable tactile response.

Figure 22:
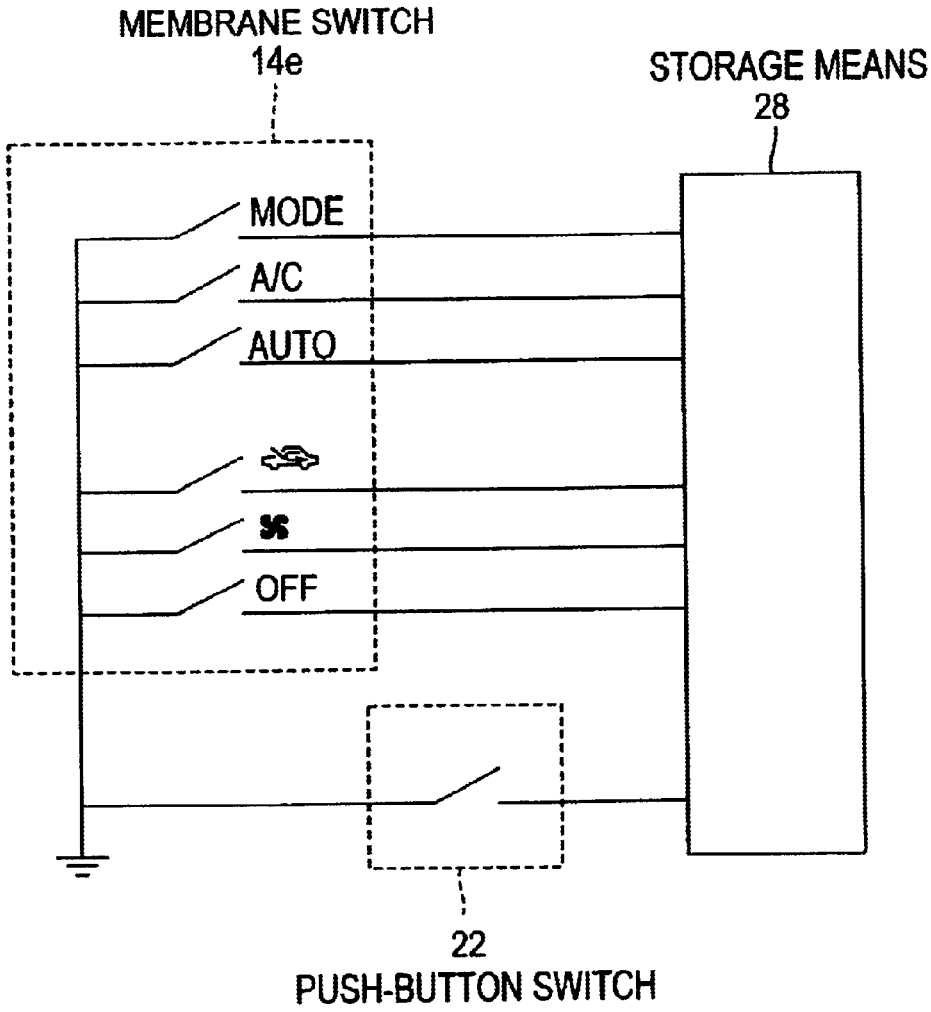
FIG. 22 is a circuit diagram for explaining another embodiment of the present invention.

FIG. 22 shows a construction that overcomes the above problem to obtain a switch of a comfortable click response. The illustrated example Uses storage means 28, which stores ON information about the membrane switch 14*e* turned ON by depression and holds the information until the push-button switch 22 turns ON. Upon turning ON of the push-button switch 22, the stored information is read out of the storage means 28.

With such a construction, even if the load on the push-button switch 22 begins to drop and the membrane switch 14*e* turns OFF, since the ON information in the preceding stage (initial stage) is held in the storage means 28, turning ON of the membrane switch 14*e* is followed by turning ON of the push-button switch 22 without fail. Accordingly, the push-button switch provides a "click" response at the same timing as turning ON of the switch in its entirety.

The storage means 28 is, for example, CPU, which is mounted on the bottom plate 21.

In the above-described embodiment, assembling of the links 16 to 18, assembling of the link members 16 and 17 with the slider 17, and assembling of the link members 16 and 17 with the case 19 are performed through the engagement of stab shafts with holes, but the invention is not limited specifically to the construction of the embodiment and it is also possible to replace the stub shaft with holes and the holes with stub shafts.

Moreover, the pusher 13, the membrane sheet 14 and the slider 15 need not always be fastened by the screws 24 to the knob 12; for example, they may also be latched by a hook ma hook which is mounted to the knob 12 for engagement with the slider 15.

Similarly, the bottom plate 21 may also be latched to th case 19 by a hook on the latter for engagement therewith, instead of using the screws 26.

Figure 23A:
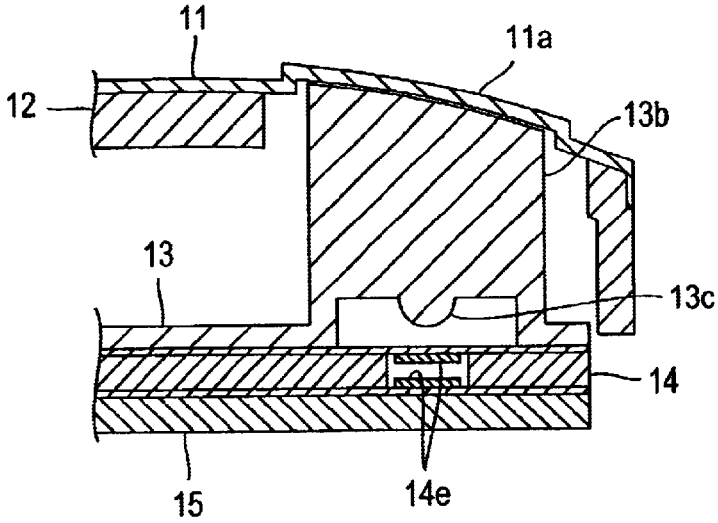
FIG. 23A is a diagram showing the relationship between the pusher 13 and the membrane switch 14*e* prior to depression in the case where the pusher 13 is made of a transparent rubber.
Figure 23B:
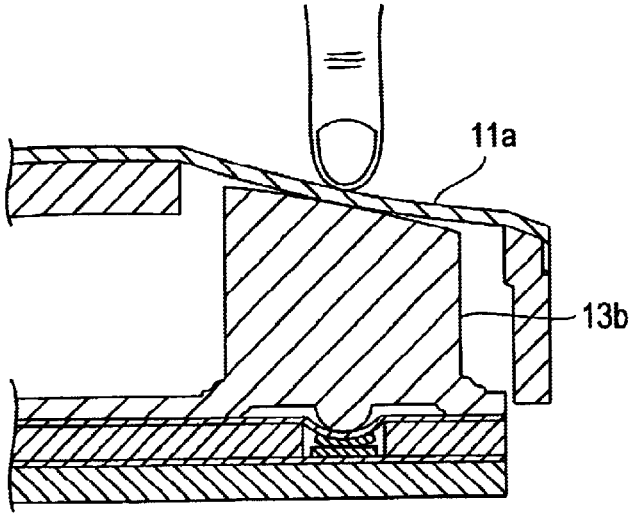
FIG. 23B is a diagram showing their relationship after depression.

The pusher 13 in this embodiment has cylindrical or tubular pusher elements 13*b* and configured so that they tilt (turn) by depression, but it is also possible that the pusher 13 is formed of transparent rubber and provided with the pusher elements 13*b* of such a structure as shown in FIGS. 23A and 23B. In this instance, the pusher element 13*b* is pressed in the direction of depression.

While in the above embodiment the link mechanism (link members 16 to 18), the slider 15, the pusher 13 and the membrane sheet 14 except its conductors are formed of a light transmitting material so as to ensure uniform irradiation of every symbol 11*b* with the light emitted from the light source 23, the link mechanism and the slider 15 need not always be formed of a light transmitting material. When a hole is formed through the slider 15 as indicated by the broken line 15W in FIG. 7 so that every symbol 11*b* is illuminated with uniform brightness, one of both of the link mechanism and the slider may be formed of a material which does not transmit light therethrough.

Figure 24:
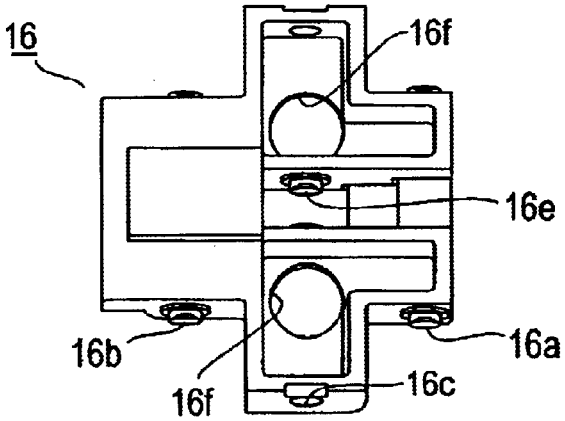
FIG. 24 is a perspective view showing an example in which holes for passing therethrough light are formed through the link member 16.
Figure 25:
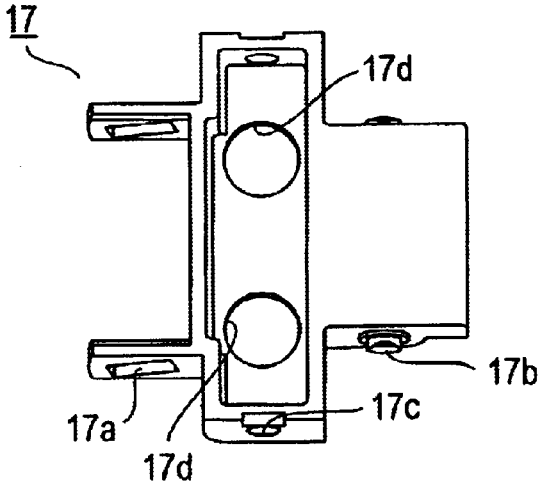
FIG. 25 is a perspective view showing an example in which holes for passing therethrough light are formed through the link member 17.
Figure 26:
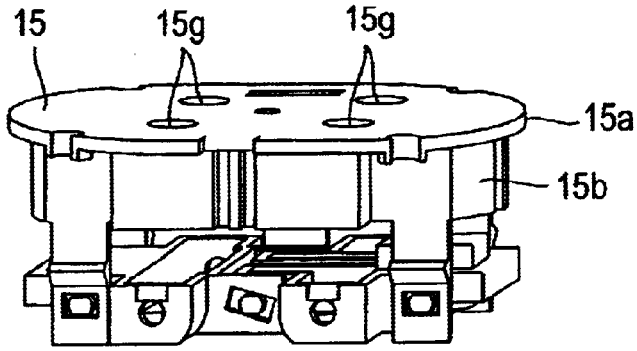
FIG. 26 is a perspective view showing an example in which holes for passing therethrough light are formed through the slider 15.

FIGS. 24 to 26 illustrate examples in which such holes for passage therethrough of light are formed through the link member 16, the link member 17 and the slider 15. The link members 16 and 17 have two holes 16*f* and 17*d*, respectively, and the slider 15 has four holes 15*g* corresponding to the holes 16*f* and 17*d*.

EFFECT OF THE INVENTION

As described above, the tactile switch unit according to the present invention permits illumination of every symbol with uniform brightness without casting thereon a shadow and provides uniform tactile response no matter which of the press areas is pushed.

Consequently, the press areas can be freely arranged, and the configuration of the symbol bearing surface, such as a three-dimensional, curved or uneven configuration, can easily be adopted. Hence, the switch unit of the present invention is good in outward appearances, highly flexible in arranging and designing the symbols, and excellent in operability.

Besides, since the timing for the push-button switch to produce the tactile "click" response coincides with the timing for tuning ON of the unit switch in its entirety by turning ON or the membrane switch and the push-button switch, the switch unit of the present invention is comfortable to use and has enhanced operability.

What is claimed is:

1. A tactile switch unit comprising:

a case;

a link mechanism having first and second links disposed in said case, rotatably supported intermediately of their ends to sad case and having their inner ends rotatably coupled to each other;

a slider located above said link mechanism and vertically movable housed in said case, and having a flat top and a plurality of legs for rotatably supporting outer ends of said first and second links;

a membrane sheet disposed on said flat top of said slider and having formed therein a plurality of membrane switches;

a knob fixedly integrated with said slider and having apertures in its top panel fitted in a top opening of said case;

a surface sheet having formed thereon a plurality of press areas and disposed on the top panel of said knob with said press areas aligned with said apertures;

a pusher having a plurality of pusher elements disposed on said membrane sheet in opposing relation to the back of said press areas, respectively, each of said pusher elements being designed so that upon depression of said press area corresponding thereto, said each pusher element is pressed to urge said membrane switch corresponding thereto;

a tactile push-button switch disposed in said case and turned ON/OFF by pivotal movement of said link mechanism;

a bottom plate attached to said case on the bottom side thereof; and a light source mounted on the inside surface of said bottom plate, for illuminating a symbol provided in said each press area;

wherein said membrane sheet except a conductor portion and said pusher are formed of a light transmitting material.

2. The switch unit of claim 1, wherein at least one of said link mechanism and said slider has a hole therethrough to pass light from said light source to said symbol.

3. The switch unit of claim 2, further comprising storage means which stores ON information about said membrane switch turned ON by said depression and outputs said stored ON information when said push-button is turned ON.

4. The switch unit of claim 1, wherein each of said pusher elements has a cylindrical configuration with one end closed and is disposed with said closed end face opposite the back of said press area corresponding thereto, a protrusion for pushing said membrane switch being provided on the open end portion of said each pusher member at one side thereof and said open end portion being supported by a hinge on the side opposite from said protrusion.

5. The switch unit of claim 2, wherein said knob is molded with said surface sheet inserted therein.

6. The switch unit of claim 1, wherein said link mechanism is provided with a third link rotatably supported by either one of said first and second links, for turning ON/OFF said push-button switch.

7. The switch unit of claim 6, further comprising storage means which stores ON information about said membrane switch turned ON by said depression and outputs said stored ON information when said push-button is turned ON.

8. The switch unit of claim 6, wherein each of said pusher elements has a cylindrical configuration with one end closed and is disposed with said closed end face opposite the back of said press area corresponding thereto, a protrusion for pushing said membrane switch being provided on the open end portion of said each pusher member at one side thereof and said open end portion being supported by a hinge on the side opposite from said protrusion.

9. The switch unit of claim 6, wherein said knob is molded with said surface sheet inserted therein.

10. The switch unit of claim 1, further comprising storage means which stores ON information about said membrane switch turned ON by said depression and outputs said stored ON information when said push-button is turned ON.

11. The switch unit of claim 1, wherein each of said pusher elements has a cylindrical configuration with one end closed and is disposed with said closed end face opposite the back of said press area corresponding thereto, a protrusion for pushing said membrane switch being provided on the open end portion of said each pusher member at one side thereof and said open end portion being supported by a hinge on the side opposite from said protrusion.

12. The switch unit of claim 1, wherein said knob is molded with said surface sheet inserted therein.

* * * * *